United States Patent [19]

Gundlach

[11] 4,078,929

[45] Mar. 14, 1978

[54] METHOD FOR TWO-COLOR DEVELOPMENT OF A XEROGRAPHIC CHARGE PATTERN

[75] Inventor: Robert W. Gundlach, Victor, N.Y.

[73] Assignee: Xerox Corporation, Stamford, Conn.

[21] Appl. No.: 744,916

[22] Filed: Nov. 26, 1976

[51] Int. Cl.[2] ..... G03G 13/01

[52] U.S. Cl. ..... 96/1.2; 427/19

[58] Field of Search ..... 96/1.2, 1 R; 427/19, 427/14

[56] References Cited

U.S. PATENT DOCUMENTS

| | | | |
|---|---|---|---|
| 2,777,418 | 1/1957 | Gundlach | 96/1 SD |
| 2,784,109 | 3/1957 | Walkup | 96/1 R X |
| 2,879,397 | 3/1959 | Lehmann | 96/1.2 X |
| 2,890,968 | 6/1959 | Giaimo | 96/1.2 X |
| 3,013,890 | 12/1961 | Bixby | 96/1.2 X |
| 3,045,644 | 7/1962 | Schwertz | 118/645 |
| 3,094,429 | 6/1963 | Howell | 427/19 |
| 3,702,483 | 11/1972 | Fantuzzo | 96/1.2 |
| 3,854,043 | 12/1974 | Hukase et al. | 250/315 A |
| 4,039,831 | 8/1977 | Lehmann | 96/1.2 X |

OTHER PUBLICATIONS

Schaffert, *Electrophotography,* 1965, pp. 153–159.

*Primary Examiner*—David Klein
*Assistant Examiner*—John R. Miller
*Attorney, Agent, or Firm*—James J. Ralabate; Eugene O. Palazzo; Max J. Kenemore

[57] ABSTRACT

A charge pattern of a single polarity and having at least three different levels of potential is developed in two colors by utilizing relatively negatively charged toner particles of one color and relatively positively charged toner particles of a second color.

10 Claims, 5 Drawing Figures

METHOD FOR TWO-COLOR DEVELOPMENT OF A XEROGRAPHIC CHARGE PATTERN

BACKGROUND OF THE INVENTION

This invention relates generally to a method for making visible electrostatic charge patterns and more particularly to a method by which such charge patterns are developed in two colors.

In the practice of xerography, it is the general procedure to form an electrostatic latent image on a xerographic surface by first uniformly charging a photoconductive insulating surface. The charge is selectively dissipated in accordance with a pattern of activating radiation corresponding to an original image. The selective dissipation of the charge leaves a charge pattern on the imaging surface corresponding to the areas not struck by radiation.

This charge pattern, also commonly known as an electrostatic latent image, is made visible by developing it with a toner. The toner is generally a colored powder which adheres to the charge pattern by electrostatic attraction.

The developed image is sometimes then fixed to the imaging surface or is transferred to a receiving sheet to which it is fixed.

This method of forming and developing charge patterns is set forth in greater detail in U.S. Pat. No. 2,297,691 to C. F. Carlson. Still other means of forming and developing electrostatic images are set forth in U.S. Pat. No. 2,647,464 to J. P. Ebert; U.S. Pat. No. 2,576,047 to R. M. Schaffert and U.S. Pat. No. 2,825,814 to L. E. Walkup.

Modern business and computer needs oftentimes make it advantageous and desirable to reproduce originals which contain two colors. It is sometimes important that the copy reproduced also contain two colors.

Accounting reports having certain information highlighted in a second color are one example of a type of document which would desirably be copied in two colors. Computer generated cathode ray tube (CRT) displays are another example in which it is somtimes desirable to reproduce an image in two colors. For instance, it is sometimes desirable that those portions of the CRT display image representing permanent forms are reproduced in a first color and those portions of the image representing variable information are reproduced in a second color.

There are known several useful methods of making copies having two colors. Some of these methods make high quality images in two colors; however, there is need for improvements in these methods. Improvements relating to the simplification of the two-color imaging process as well as to increasing image quality are especially desirable.

One method of two-color reproduction is disclosed in U.S. Pat. No. 3,013,890 to W. E. Bixby in which a charge pattern of either a positive or negative polarity is developed by a single, two-colored developer. The developer of Bixby comprises a single carrier which supports both triboelectrically relatively positive and relatively negative toner. The positive toner is a first color and the negative toner is of a second color.

The method of Bixby develops positively charged image areas with the negative toner and develops negatively charged image areas with the positive toner. A two-color image occurs only when the charge pattern includes both positive and negative polarities.

Two-color development of charge patterns created by the Tesi technique is disclosed by F. A. Schwertz in U.S. Pat. No. 3,045,644. Like Bixby, Schwertz develops charge patterns which are of both a positive and negative polarity. Schwertz's development system is a set of magnetic brushes, one of which applies relatively positive toner of a first color to the negatively charged areas of the charge pattern and the other of which applies relatively negative toner to the positively charged areas.

Methods and apparatus for making colored xerographic images using colored filters and multiple development and transfer steps are disclosed, respectively, in U.S. Pat. Nos. 3,832,170 to K. Nagamatsu et al and 3,838,919 to T. Takahashi.

U.S. Pat. No. 3,816,115 to R. W. Gundlach and L. F. Bean discloses a method for forming a charge pattern having charged areas of a higher and lower strength of the same polarity. The charge pattern is produced by repetitively charging and imagewise exposing an overcoated xerographic plate to form a composite charge pattern. Development of the charge pattern in one color is disclosed.

A method of two-color development of a charge pattern, preferably with a liquid developer, is disclosed in the commonly assigned copending application Ser. No. 587,479, filed June 16, 1975. This method requires that the charge pattern for attracting a developer of one color be above a first threshold voltage and that the charge pattern for attracting the developer of the second color be below a second threshold voltage. The second threshold voltage is below the first threshold voltage. Both the first and second charge patterns have a higher voltage than does the background.

SUMMARY OF THE INVENTION

It is therefore an object of this invention to present a method for producing two-color xerographic images whereby the above-mentioned needs are fulfilled and the disadvantages of prior known methods are overcome.

It is another object of the present invention to supply a method for developing in two colors a charge pattern of one polarity.

It is a further object of this invention to furnish a xerographic two-color development method of a charge pattern which is produced by a single charge-expose sequence.

It is yet another object of this invention to present a method for forming two-color xerographic copies from monochrome originals.

These and other objects are provided by a method which comprises, generally speaking, creating a charge pattern of one polarity on an imaging surface. The charge pattern includes areas of a first charge of a background voltage and areas of charge of image voltages. The image voltages are both greater and smaller in magnitude than the background voltage.

The charge pattern is developed with toner particles of a first and a second color. The toner particles of one of the colors is positively charged and the toner particles of the other color are negatively charged.

In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging suface supporting the charge pattern.

In another embodiment, the toner particles are presented to the charge pattern by a pair of magnetic brushes. Each brush supplies a toner of one color and one charge.

In a preferred embodiment, the development system is biased to about the background voltage. Such biasing results in a developed image of improved color sharpness.

The developed image can be transferred to a receiving surface and fixed.

BRIEF DESCRIPTION OF THE DRAWINGS

Other objects and advantages of the invention will become readily apparent from the following detailed description of the preferred embodiments thereof when read with reference to the drawings in which.

DESCRIPTION OF THE PREFERRED EMBODIMENTS

Figure 1:
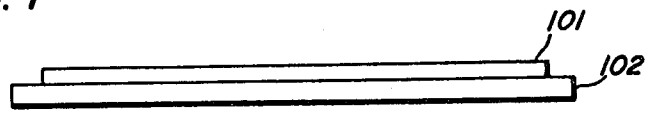
FIG. 1 is a side view of a xerographic plate employed in the practice of the invention.

Referring more specifically to FIG. 1, there is shown a cross-sectional view of a xerographic plate which is useful in the present invention. It is to be understood that any imaging surface on which a charge pattern can be established is useful as an imaging surface. Examples of such surfaces are dielectrics such as glass and synthetic plastic materials. More typically, the imaging surface is a xerographic plate.

The imaging surface shown in FIG. 1 comprises photoconductive insulating layer 101 on grounded conductive substrate 102. Layer 101 is constructed from any standard photoconductive materials such as, for example, vitreous selenium, sulfur, anthracene and tellurium. It can also be a finely ground photoconductive insulating material dispersed in a high resistance electrical binder, as disclosed in U.S. Pat. No. 3,121,006 to Middleton et al.

Layer 101 also can be an inorganic photoconductive pigment dispersed in a photoconductive insulating material such as those disclosed in U.S. Pat. No. 3,121,007 to Middleton et al. Also useful as layer 101 is an organic photoconductor such as phthalocyanine in a binder. Generally, any photoconductive insulating material which is suitable for use in xerographic reproduction techniques is useful.

The imaging surface may be rigid or flexible. It can be flat, or it can have other configurations, such as an arcuate shape. An arcuately shaped imaging surface is readily attached to a rotating cylinder for use in repetitive and automatic copying devices.

Grounded conductive support 102 is usefully made from any conductive material which is sufficiently strong to support layer 101. Suitable materials include aluminum, nickel, brass, steel, copper, conductive rubbers and conductive glass. More typically, support 102 is aluminum or conductive glass. The conductive glass is used when imagewise exposure is to be from the rear.

Whenever the xerographic method of forming a charge pattern on the imaging surface is used, layer 101 is first uniformly charged in the dark to one polarity. After charging, layer 101 is exposed to an original image having image areas which are both lighter and darker than the image background. Exposure is suitably by any of the reflected or transmitted light modes which are well known in xerography.

The original may be any image having image areas which are seen by layer 101 to be both darker and lighter than the background area. An example of such useful original images are CRT displays in which the background area is grey and the image areas are white and black. Another example of a useful original is a sheet of grey paper having white and black marks on its surface. Other colors of paper may be selected to match the spectral response of particular photoreceptors. For example, yellow paper is useful with a selenium photoreceptor.

The three-level charge pattern can also be produced by modulating laser light as it scans a uniformly charged photoconductive imaging surface.

Figure 2:
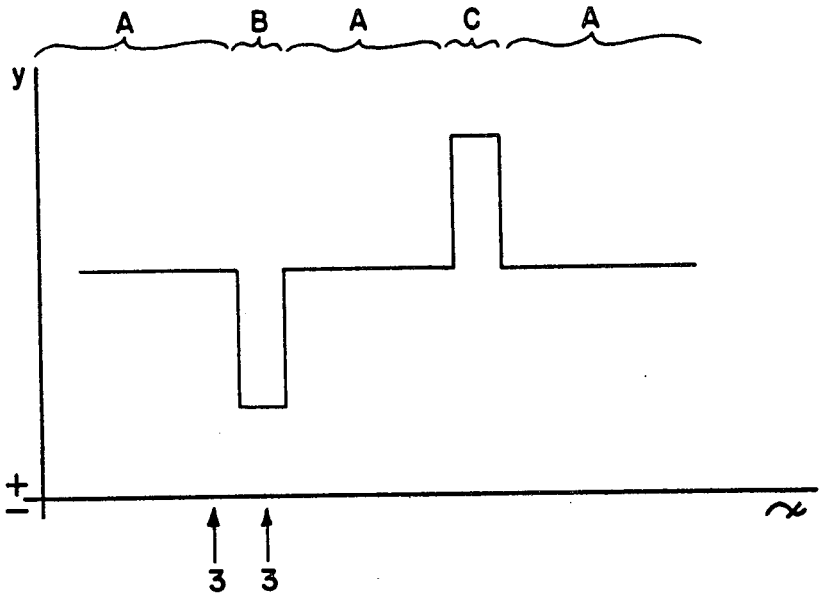
FIG. 2 is a graphical illustration representing the comparative voltage values of the various areas of a charge pattern useful in the practice of the present invention.

Referring more specifically to FIG. 2, there is shown a graphical representation of the comparative voltage strengths of the various areas of a charge pattern made in the manner just described. Any point along the $x$ axis represents a discrete point of the plate's surface and the $y$ axis represents the voltage level at that discrete point.

Sections A of $x$ represent the comparative voltage level of the background areas of the charge pattern. Section B of $x$ represents the voltage of the image area portion which is lighter than the background. Section C of $x$ represents the voltage of the image area which is darker than the background area.

Typical voltages may be assigned to the various portions of the charge pattern for purposes of illustration. An imaging surface is typically charged to about 1,000 v. in the dark prior to exposure to the original image. Upon exposure the dark areas of the original, such as black typewriter type, will typically result in a discharge of not more than about 100–200 v. The light areas, such as white markings on yellow paper will discharge the corresponding parts of the photoreceptor to about 100–200 v. The background area, such as that corresponding to grey paper, will typically be from about 400 to about 600 v.

In FIG. 2, typical voltages would be 500 v. for Section A of $x$, 150 v. for Section B of $x$ and 800 v. for Section C of $x$. If, for example, a CRT display is used to image the charged imaging surface, the black portions of the display typically result in 800 v. areas in the charge pattern corresponding with C of $x$ in FIG. 2. The light areas of the CRT display typically result in 150 v. charge pattern areas corresponding with B of $x$ in FIG. 2, and the grey background areas of the display typically result in 500 v. areas of the display corresponding with Sections A of $x$ in FIG. 2.

Figure 3:
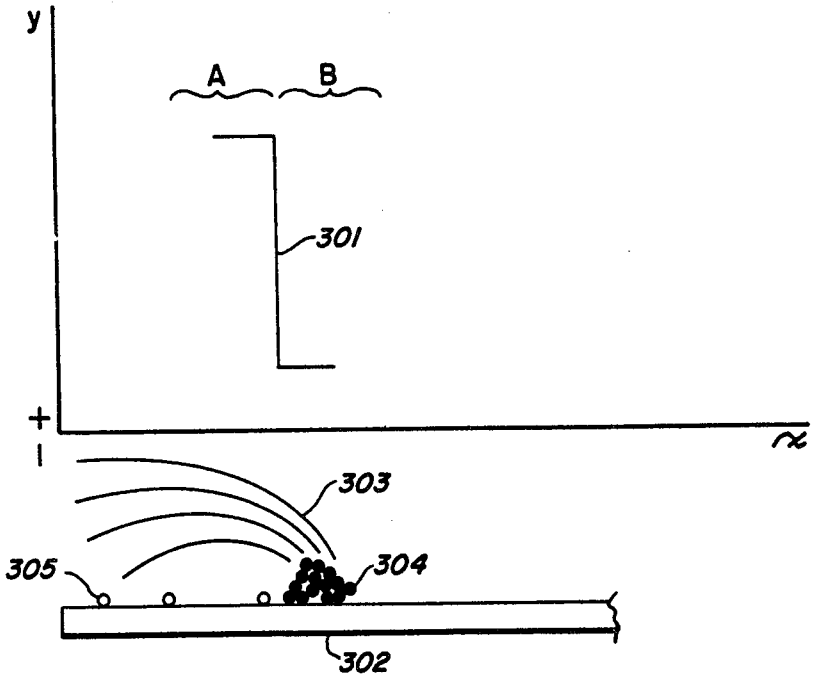
FIG. 3 is a graphical and cross-sectional pictorial representation of the development of a portion of the charge pattern of FIG. 2 with a two-color developer.

Referring more specifically now to FIG. 3, there is shown both graphically and pictorially the development of a portion of the charge pattern of FIG. 2 with a two-color developer. A slightly enlarged view is shown of the portion of the charge pattern indicated by arrows 3—3 of FIG. 2. This portion shows edge 301 where charge A representing the background of the original and charge B representing the lighter image portion of the original meet.

The phenomenon of edge-effect development is well known in xerography. Stated simply, this phenomenon is the tendency of toner particles to adhere to the edge between two levels of charge such as edge 301. It is generally believed that this is because the concentration of the lines of flux between the charged areas as more concentrated at the edge.

In the pictorial portion of FIG. 3, there is shown imaging surface 302 which also corresponds to arrows 3—3 of FIG. 2. Flux lines 303 show a relative concentration corresponding with edge 301 between the relatively positive part A and the relatively negative part B of the charge pattern. Portions A and B of the charge pattern are relatively negative and positive with respect to each other even though they are both of the same polarity.

Also shown in the pictorial portion of FIG. 3 is a typical concentration of toner particles at edge 301. On the relative negative (B) side of edge 301, there is a high concentration of positively charged toner particles 304, while on the relatively positive side (A) of edge 301 there are comparatively fewer negatively charged toner particles 305. The higher concentration of positively charged toner particles is believed to correspond with the higher concentration of flux lines in part B of the charge pattern.

Positively charged toner particles 304 are of a first color, and negatively charged toner particles 305 are of a second color. It can readily be seen that normal developmemt of edge 301 with a two-colored developer results in an image having the color of the positively charged toner particles and being fringed with the color of the negatively charged toner particles. The opposite color arrangement will occur when the edges between the A and C portions of the charge pattern are developed.

Development is by any suitable means for bringing the toner particles in contact with the charge pattern. Typically, cascade development or magnetic brush development can be used. Cascade development is generally described in U.S. Pat. No. 2,618,551 to Walkup and U.S. Pat. No. 2,638,461 to Walkup and Wise.

Cascade development using a developer comprising a carrier which supports two colors of toner particles is disclosed in U.S. Pat. No. 3,013,890 to W. E. Bixby. A carrier bead supports a first toner of a first color which is triboelectrically positive with respect to the carrier and a second toner of a second color which is triboelectrically negative with respect to the carrier. Whenever the developer described by Bixby is cascaded across an imaging surface which carries a charge pattern such as that shown in FIGS. 2 and 3, the relatively negative toner particles are attracted from the carrier to the relatively positive portions of the charge pattern. Likewise, the relatively positive toner particles are attracted to the relatively negative portions of the charge pattern. Development in two colors is achieved as described in connection with FIG. 3.

It is also known to use for cascade development a developer comprising a mixture of two types of carrier beads. One of such beads is relatively triboelectrically positive and the other is relatively triboelectrically negative. The beads attract toner particles which are oppositely triboelectrically charged and which are differently colored. Such a developer operates in much the same way as the developer disclosed by Bixby to develop a charge pattern such as that of FIG. 2 in two colors.

The charge pattern shown in FIGS. 2 and 3 can also be developed by magnetic brush development systems such as those disclosed by F. A. Schwertz in U.S. Pat. No. 3,045,644. Magnetic brushes for use in developing charge patterns in one color are well known. Schwertz describes the use of two brushes operating in tandem. One brush applies a toner of a first color which is triboelectrically positive to develop charges of a negative polarity. A second brush applies toner of a second color which is triboelectrically negative to develop charges which have a positive polarity. When using the method of Schwertz, it is often desirable to develop first with the highlight color and then with the black or darker color to avoid contamination of the lighter color with the darker.

The magnetic brush system of Schwertz can be used to develop the relatively positive and negative portions of the charge pattern in two colors in the present invention even though the various portions of the present charge pattern are of the same polarity.

Whether the charge pattern is developed by a suitable cascade method or a magnetic brush method, an image of one color will have around its edge a fringe of the second color. The fringe arises as explained above in connection with FIG. 3. Such a fringe is typical of development situations wherein relatively positive and negative differences in charges of the same polarity are developed in two colors.

Such a fringe development in the second color is usually not unacceptable. However, referring more specifically to FIG. 4, there is shown a charge pattern in which such fringe development can become a problem.

Charge pattern 401 is graphically shown to be a series of substantially evenly spaced areas of charge 402 which are relatively positive when compared to the background areas of charge 403.

Figure 4:
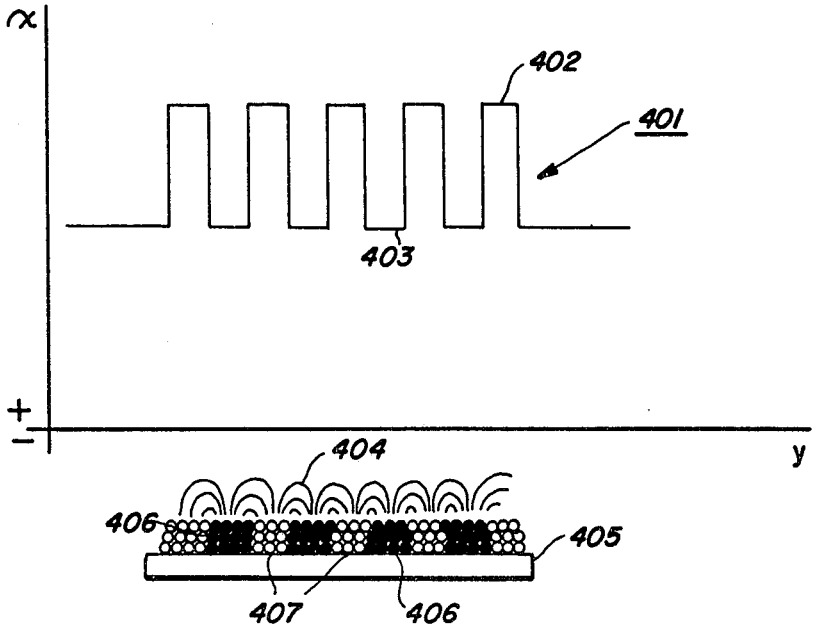
FIG. 4 is a cross-sectional view of a charge pattern on an imaging surface showing the flux lines between various portions of the charge and showing the attraction of toner particles to the various parts of the charge pattern.

In the pictorial portion of FIG. 4, flux lines 404 extend across portions of imaging surface 405 corresponding to the relatively positive and relatively negative portions of charge pattern 401. Flux lines 404 seem to be about evenly concentrated in the relatively positive and negative areas compared with the uneven concentration of flux lines 303 of FIG. 3.

Positively charged toner particles 406 of a first color (filled-in circles) and negatively charged toner particles 407 of a second color (open circles) are about evenly concentrated in the relatively negative and relatively positive areas of imaging surface 405. Thus, it is seen that a charge pattern including a close, uniform repetition of relatively positive and negative areas (e.g. closely spaced stripes) can result in undesirable development of background charge 403 as a second color.

Figure 5:
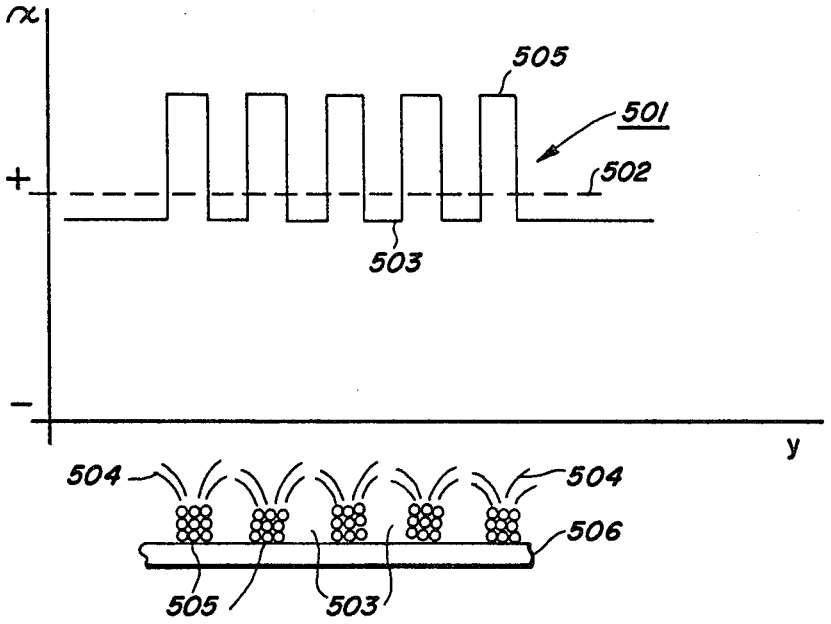
FIG. 5 is a graphical and cross-sectional pictorial representation of the effect of biasing the development system to the background voltage.

Referring more specifically to FIG. 5, there is shown graphically a charge pattern 501 similar to charge pattern 401 of FIG. 4. However, in FIG. 5 electrical bias 502 is applied to the development system used to develop charge pattern 501. Bias 502 is substantially at the background level of charge pattern 501. The effect of such a bias is to move the zero voltage level to the background charge 503 and, in effect, to change the polarity of everything below the level of bias 502 during development.

The effect of the movement of the zero voltage level to about background charge level 503 is to make level 503 electrically neutral in terms of development fields. Flux lines 504 from the positively charged areas 505 of imaging surface 506 do not extend to the background areas 503 and developer particles 507 are attracted only to the positively charged portions of pattern 501.

Biasing of both cascade and magnetic brush development are well known in the art. Typical examples of biased development systems are disclosed in U.S. Pat. Nos. 2,777,418 to Gundlach, 3,347,691 to J. M. Lyles and 3,950,089 to L. J. Fraser et al.

The developed image can be transferred to a receiver sheet and fixed, if desired. Because the differently colored toner particles are of different polarities, they should be uniformly charged to a single polarity if bias assisted transfer is used. The toner particles should be charged to a polarity opposite that of the bias transfer potential.

Alternatively, pressure transfer can be used without biasing. However, the results of pressure transfer are generally less desirable than bias transfer results. Both bias transfer and pressure transfer are well known in the art.

It should be noted that the above described method has proved to be very effective through experimentation and any inaccuracy in the theoretical operation thereof as described and illustrated is not to be construed as being limiting of the invention.

Methods of performing the two-color development process of the presemt invention will now be described by way of example by which other useful embodiments and procedures will become clear to those skilled in the art.

EXAMPLE I

An original is prepared by typing both white and black characters on a sheet of yellow paper. A xerographic plate comprising a 50 micron layer of selenium coated on a 50 mil. thick aluminum substrate is charged in the dark by corona discharge to 1,000 v. and is exposed to light reflected from the original.

In the dark, the plate is cascaded with a developer comprising an equal volume mix of carrier beads which are triboelectrically relatively positive and negative and an equal volume mix of triboelectrically relatively positive and negative toner particles. The positive toner particles are red and the negative toner particles are blue.

The developer is cascaded across the imaging surface in the dark by rolling an amount of the developer back and forth across the exposed plate six times. The plate is tilted to cause the rolling of the developer.

The plate is then observed in ambient light. A developed image is observed in which red areas correspond to the white typed characters of the original and blue areas correspond to the black typed areas of the original. The red characters are fringed with the blue color and the blue characters are fringed with a red color.

EXAMPLE II

The procedures of Example I is followed except that the original is a computer generated CRT display having characters both lighter and darker than the background.

The plate developed after exposure to the CRT display has image patterns in which red areas correspond to the light CRT display images and blue areas correspond to the darker areas of the CRT display. The images of one color are fringed with images of a second color.

EXAMPLE III

The procedure of Example III is followed except that the plate is developed by passing it into contact with a set of magnetic brushes. One member of the set applies the relatively positively charged red toner particles and the second member of the set applies the relatively negatively charged blue toner particles. The developed plate of Example III is substantially the same as the developed plate of Example II.

EXAMPLE IV

The procedure of Example II is followed except that the developer is cascaded over the tilted plate surface by pouring it through an electrically biased chute. The chute directs the developer across the plate surface in a substantially even distribution.

Prior to the cascade development of the plate, it is determined by use of a potentiometer that the plate areas corresponding to the light image areas of the CRT display have a charge of about 250 v. The plate areas corresponding with the darker image areas have a charge of about 850 v., and the plate areas corresponding with the background areas have a charge of about 500 v.

The developer chute is biased to about 500 v. of the same polarity as the charge pattern (positive).

After cascade development, an image is observed on the plate which matches the CRT display in shape. Developed image areas correspond in color to the darker and lighter CRT display images as they do in Example II except that the images of each color are not fringed with the second color.

EXAMPLE V

The procedure of Example III is followed except that both magnetic brush developers are biased to 500 v. (+) as in Example IV.

The developed image matches the CRT display in shape and corresponds in color as indicated in connection with Example II. However, there is no fringe of the second color around the colored image areas.

EXAMPLE VI

A selenium xerographic plate is uniformly positively charged to about 1,000 v. in the dark. It is then subjected to horizontal line-by-line scanning by light from a Model 124B 15 miliwat helium-neon laser available from Spectra Physics, Mountain View, CA.

Before impinging the plate, the laser light passes through an acusto-optic linerarized modulator Model AOM-40 available from Intra-Action Corp., Bensonville, Ill. The Model AOM-40 modulator is driven by a Model ME40G signal processor with gamma correction, also available from Intra-Action Corp.

The signal processor functions responsive to 3 recorded tones of $G_1$, $G_3$ and $A_5$ (Equal Tempered Chromatic Scale, $A_4=440$) during the scanning. The sound pattern is repeated routinely during scanning so that the first third of each line is struck with light responsive to the $G_1$ pitch, the second third struck with light responsive to the $G_3$ pitch and the third third is struck with light responsive to the $A_5$ pitch.

After scanning, the plate is developed by the cascade process of Example I. The developed plate is observed to have a vertical blue line with a red edge effect corresponding to the interface of the $G_1$ pitch and the $G_3$ pitch. The plate also has a vertical red line with a blue edge effect corresponding to the interface between the $G_3$ pitch and the $A_5$ pitch.

The developed plate is uniformly negatively charged to −500 v. with a corotron to bring all the developer particles to the same polarity. A piece of 20 lb. bond paper is placed over the developed plate on the image side and the sandwich thus formed is passed between a set of squeeze rollers. The squeeze roller on the paper side of the sandwich is positively biased to 1,000 v. to aid transfer.

The sandwich is separated, and the developed image is observed to have transferred to the paper. The image is fixed on the paper by spraying with lacquer.

Although the invention has been described with relation to various specific and preferred embodiments, it is not intended to be limited thereto. Those skilled in the art will recognize that variations and modifications may be made which are within the spirit of the invention and the scope of the appended claims. For example, while the inventive process has been described mainly in connection with a single charge-expose-develop sequence, it can be used in an automatic machine for repetitive sequential operations with the developed image being transferred to a receiver sheet between each sequence.

What is claimed is:

1. A method for producing a xerographic image having two separate information areas in two separate colors, respectively, the method comprising:

(a) creating a charge pattern of one polarity on an imaging surface wherein the pattern comprises a first area of charge corresponding to the original image background, a second area of charge of a higher potential than the first area of charge and a third are of charge of a lower potential than the first area of charge, said second and third areas of charge corresponding to two separate information areas of the original image, respectively; and (b) developing the charge pattern with toner particles of a first color and toner particles of a second color, the toner particles of said first color being positively charged and the toner particles of said second color being negatively charged, wherein said two separate information areas of the original image are reproduced in said two separate colors, respectively.

2. The method of claim 1 wherein the charge pattern is established by exposing a uniformly charged xerographic plate to an original image which comprises areas of image which are both darker and lighter than the background areas.

3. The method of claim 1 wherein the developing of the charge pattern is accomplished by a cascade developing means.

4. The method of claim 1 wherein the developing of the charge pattern is accomplished by a magnetic brush developing means.

5. The method of claim 4 wherein the developing of the charge pattern is accomplished by a magnetic brush developing means comprising a first and second magnetic brush wherein one of the first and second magnetic brush applies the positive toner particles and the other of the first and second magnetic brush applies the negative toner particles to the charge pattern.

6. The method of claim 1 wherein developing of the charge pattern is accomplished with a developing means which is electrically biased to substantially the background voltage so that the areas of image voltage which have a greater value than the background area are relatively electrically positive with respect to the developing means and the areas of image voltage which have a lower value than the background area are relatively electrically negative with respect to the developing means.

7. The method of claim 1 including the additional step of fixing the developed image to the imaging surface.

8. The method of claim 1 including the additional step of transferring the developed image to a receiving surface.

9. The method of claim 8 wherein the transferred image is fixed to the receiving surface.

10. The method of claim 8 wherein the transferring step comprises uniformly charging the developed image to one polarity and employing an oppositely biased transfer means.

* * * * *